US005897406A

United States Patent [19]

Benes et al.

[11] Patent Number: 5,897,406

[45] Date of Patent: Apr. 27, 1999

[54] ELECTRICAL TERMINAL FOR GLASS SHEETS

[75] Inventors: Kevin C. Benes, Willowbrook; Yves Le Pottier, Geneva; Bruce F. Smith, Plainfield, all of Ill.

[73] Assignee: Molex Incorporated, Lisle, Ill.

[21] Appl. No.: 08/911,841

[22] Filed: Aug. 15, 1997

[51] Int. Cl.[6] ..... H01R 4/48

[52] U.S. Cl. ..... 439/859; 439/917

[58] Field of Search ..... 439/872, 879, 439/883, 888, 917, 859, 83, 876, 909; 228/112.1, 122.1; 174/250, 261; 343/906, 704, 713

[56] References Cited

U.S. PATENT DOCUMENTS

| | | | |
|---|---|---|---|
| 4,089,817 | 5/1978 | Kirkendall | 343/713 |
| 4,112,941 | 9/1978 | Larimore | 600/394 |
| 4,425,021 | 1/1984 | Nicolino | 439/874 |
| 4,453,033 | 6/1984 | Duff et al. | 174/52 FP |
| 4,671,591 | 6/1987 | Archer | 439/859 |
| 5,098,320 | 3/1992 | Colleran et al. | 439/876 |
| 5,176,543 | 1/1993 | Brooks | 439/859 |
| 5,232,383 | 8/1993 | Barnick | 439/859 |
| 5,268,700 | 12/1993 | Hirotsu et al. | 343/713 |
| 5,534,879 | 7/1996 | Braun et al. | 343/906 |
| 5,735,446 | 4/1998 | White et al. | 228/114.5 |
| 5,738,534 | 4/1998 | Ingles et al. | 439/83 |

*Primary Examiner*—Neil Abrams
*Assistant Examiner*—Barry Standig
*Attorney, Agent, or Firm*—Stacey E. Caldwell

[57] ABSTRACT

An electrical terminal is provided for an electrically heated glass sheet. The terminal includes a base plate defining a central axis generally perpendicular thereto. The base plate is concentric about the axis to facilitate spin-soldering the terminal to a conductive pad on the glass sheet. A terminal post projects upwardly from the base plate for connection to an appropriate mating terminal. The terminal is a drawn, one-piece laminated structure including a base conductor layer and a solder layer.

4 Claims, 6 Drawing Sheets

ELECTRICAL TERMINAL FOR GLASS SHEETS

FIELD OF THE INVENTION

This invention generally relates to the art of electrical connectors and, particularly, to a male electrical terminal. The terminal is specifically applicable for use with an electrically heated glass sheet, for example.

BACKGROUND OF THE INVENTION

Electrical connector assemblies are used for a wide variety of applications wherein it is desirable to interconnect an electrical device with an electrical power source. Male and female or plug and socket connectors often are used, and the connectors, themselves, employ male and female conductive terminals.

One type of electrical terminal assembly is used for electrically connecting an electrical power source with heating conductors incorporated or embedded in glass sheets, such as in rear window defrosters of automobiles or other vehicles. Specifically, the glass sheets used in the rear windows of vehicles often are heated electrically in order to eliminate or avoid fogging or frosting. Resistance conductors are incorporated or embedded on or in the glass sheet itself. Electric current is supplied to the heating resistance conductors by terminal assemblies which include a glass terminal applied generally to a conductive pad on the glass sheet. A mating harness terminal is electrically coupled to a lead line to the power source. Typically, the glass terminal is a male or plug terminal, and the harness terminal coupled to the lead line is a female or receptacle terminal.

Various problems are encountered in fabricating and using electrical terminal assemblies of the character described, particularly in use with vehicular rear window defroster applications. Applying the glass terminal to the window is also a source of varying problems. It also would be desirable to provide a glass terminal which is "omnidirectional" in which the harness terminal can be secured to the glass terminal in any direction. Protecting the harness terminal, particularly the contacts thereof, during shipping, handling and assembly also is a constant source of problems. It also is desirable to provide the terminals, particularly the harness terminal, with a low profile, yet providing contact beams which will provide high contact forces permanent set. The present invention is directed to solving these problems and satisfying the various needs described above.

SUMMARY OF THE INVENTION

An object, therefore, of the invention is to provide a new and improved electrical terminal particularly adapted for use with an electrically heated glass sheet.

In the exemplary embodiment of the invention, the terminal includes a base plate defining a central axis generally perpendicular thereto. The base plate is concentric about the central axis to facilitate spinsoldering of the terminal to a conductive pad on the glass sheet. A terminal post projects from the base plate for connection to an appropriate mating terminal, such as a female harness terminal.

As disclosed herein, the base plate is circular, the terminal post is generally cylindrical and the post is located on the central axis. The terminal post has an enlarged head portion to facilitate securely connecting the terminal to the complementary mating harness terminal.

The invention contemplates that the terminal is a one-piece structure, with the base plate and the terminal post being integral portions thereof. The terminal is a laminated structure including a base conductor layer and a solder layer. The terminal is a drawn structure fabricated from a laminated sheet of material.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
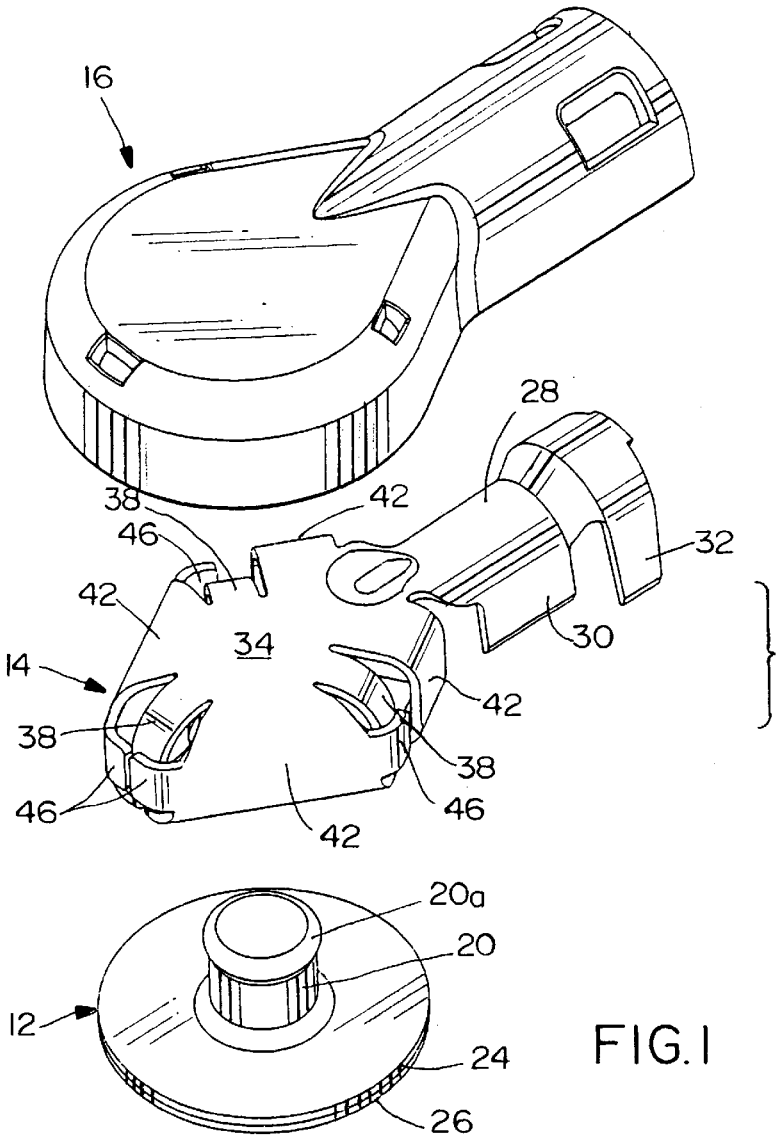
FIG. 1 is an exploded perspective view of an electrical terminal assembly incorporating the glass terminal and the harness terminal of the invention.
Figure 2:
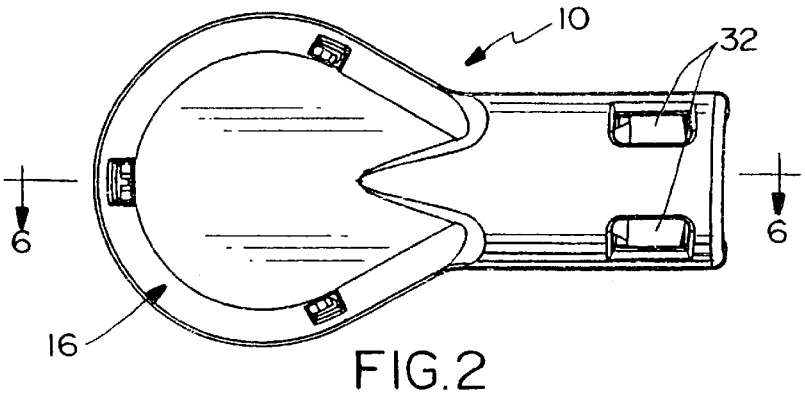
FIG. 2 is a top plan view of the terminal assembly.
Figure 3:
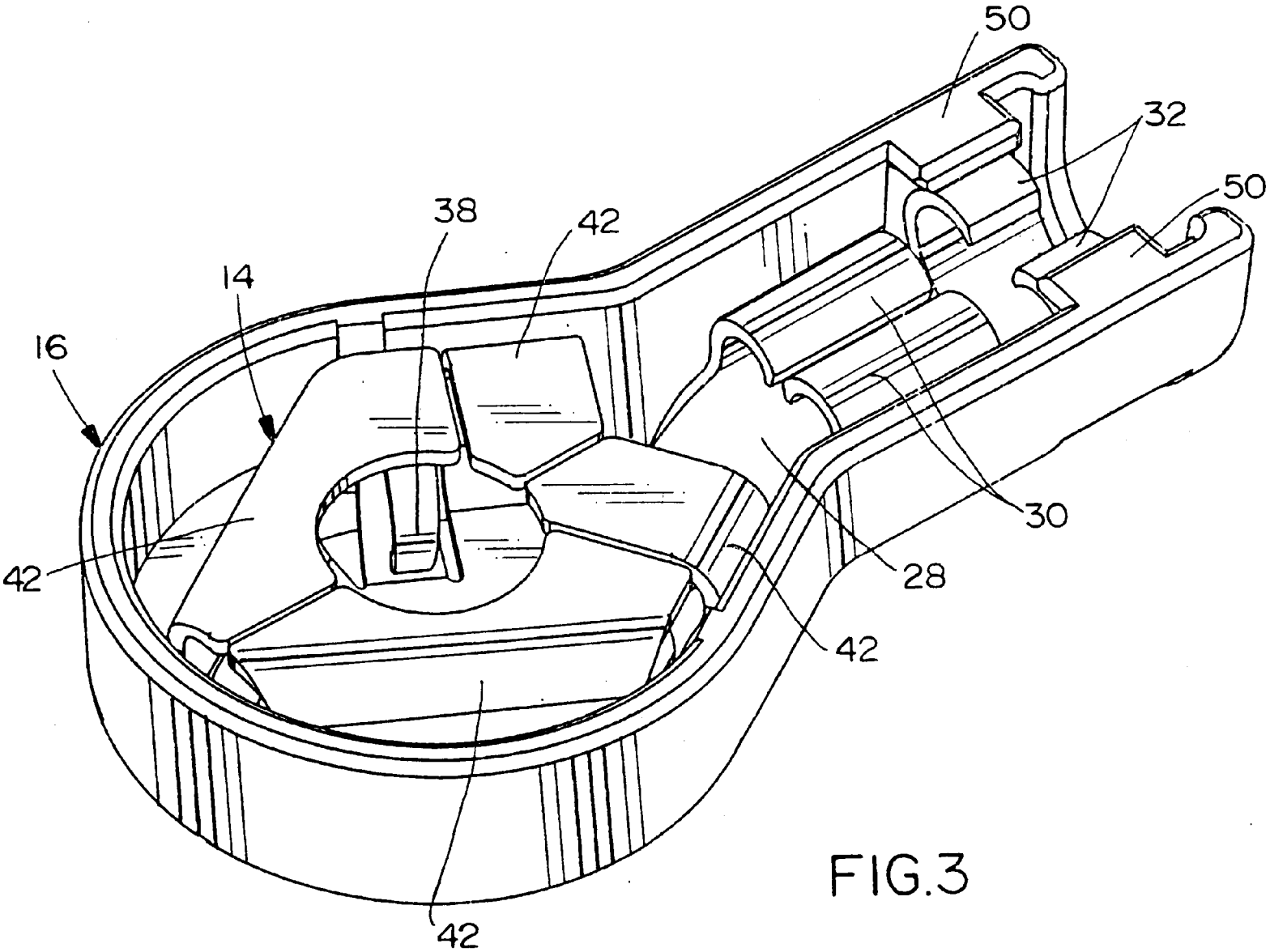
FIG. 3 is a bottom perspective view of the assembly, with the glass terminal removed.

Referring to the drawings in greater detail, and first to FIGS. 1–3, the invention is embodied in an electrical terminal assembly, generally designated 10 (FIG. 1), specifically applicable for use with an electrically heated glass sheet, such as a rear window defroster system in an automobile or other vehicle. Generally, the terminal assembly includes a glass terminal, generally designated 12, adapted for applying to the glass sheet of the rear window; a harness terminal, generally designated 14, for securing to a lead line from a power source of the vehicle; and a dielectric cover or boot, generally designated 16, which is snap fit over harness terminal 14.

Figure 6:
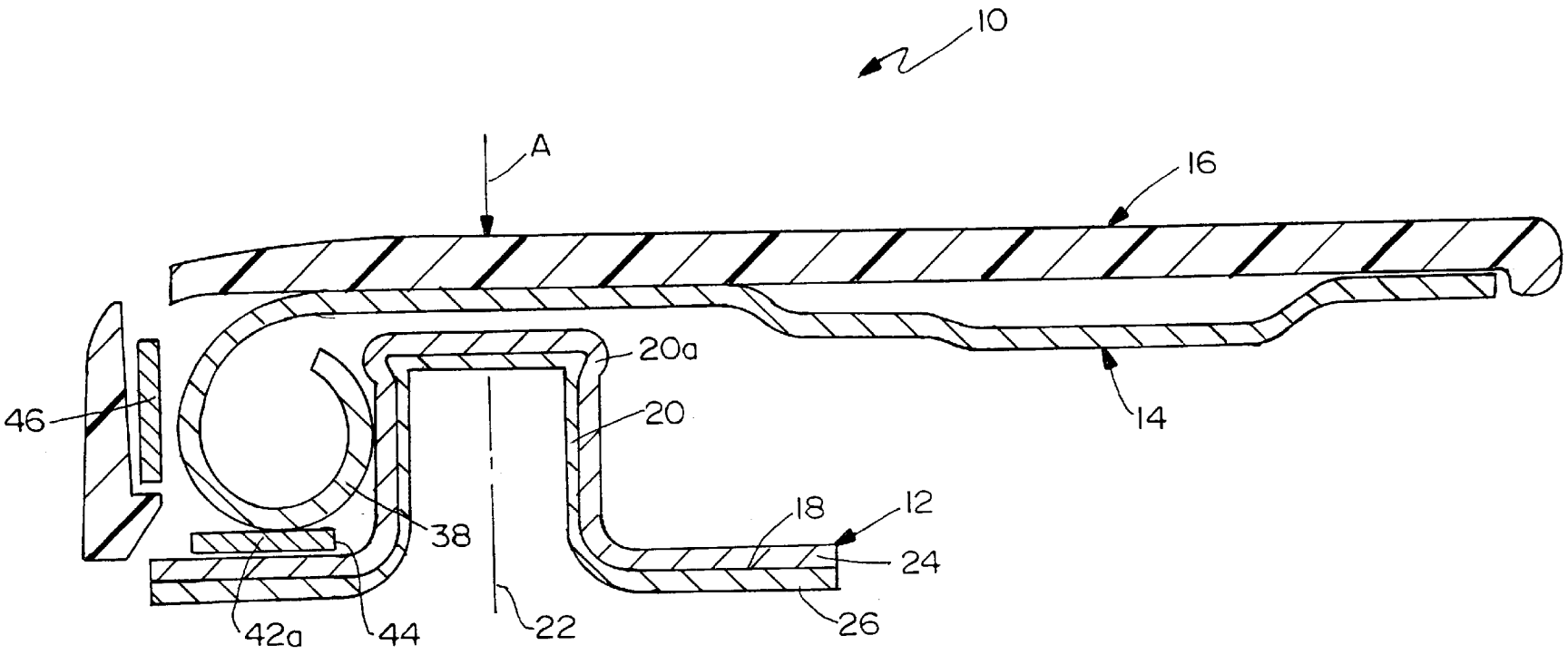
FIG. 6 is a vertical section taken generally along line 6—6 of FIG. 2.

More particularly, referring to FIG. 6 in conjunction with FIG. 1, glass terminal 12 is a one-piece laminated structure which includes a base plate portion 18 and an integral upstanding terminal post portion 20. The base plate portion is planar and circular and defines a central axis 22 (FIG. 6) perpendicular to the base plate portion. Terminal post portion 28 is cylindrical and concentric with axis 22. The terminal post portion has an enlarged head 20*a*.

Glass terminal 12 is a laminated structure and includes a relatively rigid base conductor layer 24 on the top side thereof and a solder layer 26 on the bottom side thereof. Base conductor layer 24 may be fabricated of a copper alloy, for instance. Solder layer 26 may be fabricated of an appropriate reflowable solder material.

With the unique structure of glass terminal 12 described above, the glass terminal can be connected to a conductive pad on the glass sheet of the vehicle rear window by a spin-soldering process. In other words, terminal post portion 20 of the glass terminal can be gripped by a spinning fixture as base plate portion 18 is maintained in contact with the conductive pad on the glass sheet. Specifically, solder layer 26 at the bottom of the base plate portion is maintained in contact with the conductive pad on the glass sheet. The terminal is rotated in a spinning fashion at a rapid speed about axis 22 whereupon the terminal is soldered to the conductive pad by the friction involved in the spin soldering process.

Figure 4:
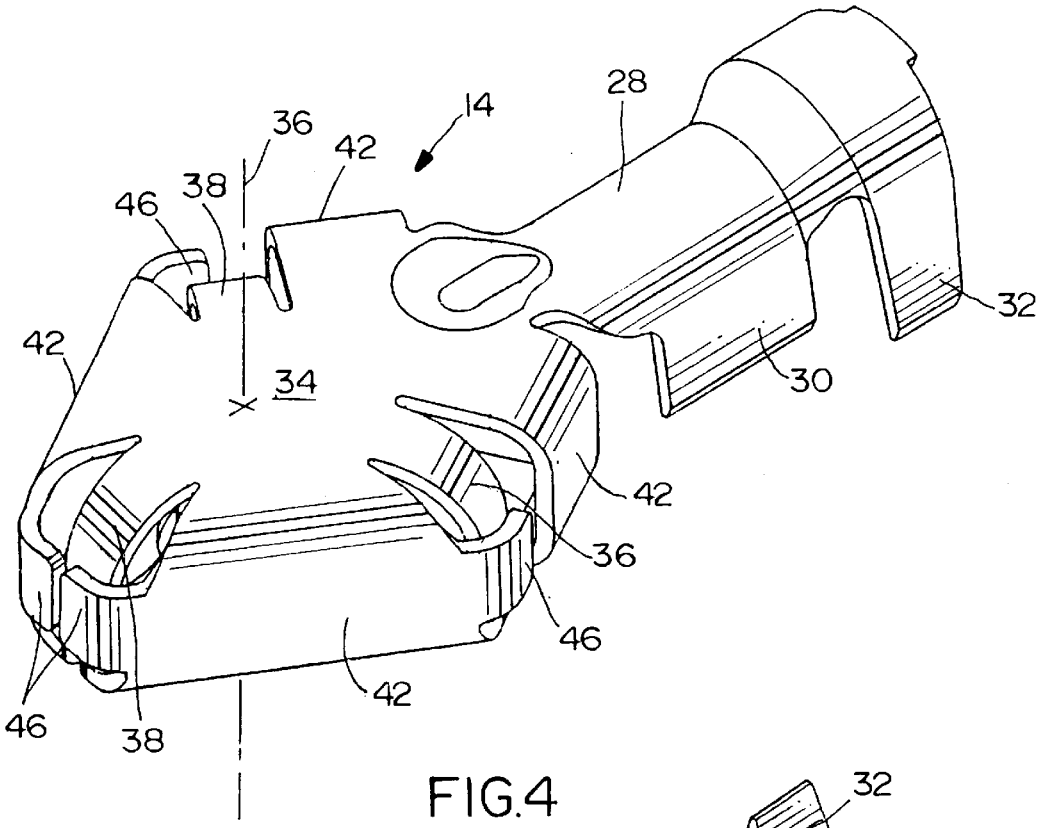
FIG. 4 is a top perspective view of the harness terminal.
Figure 5:
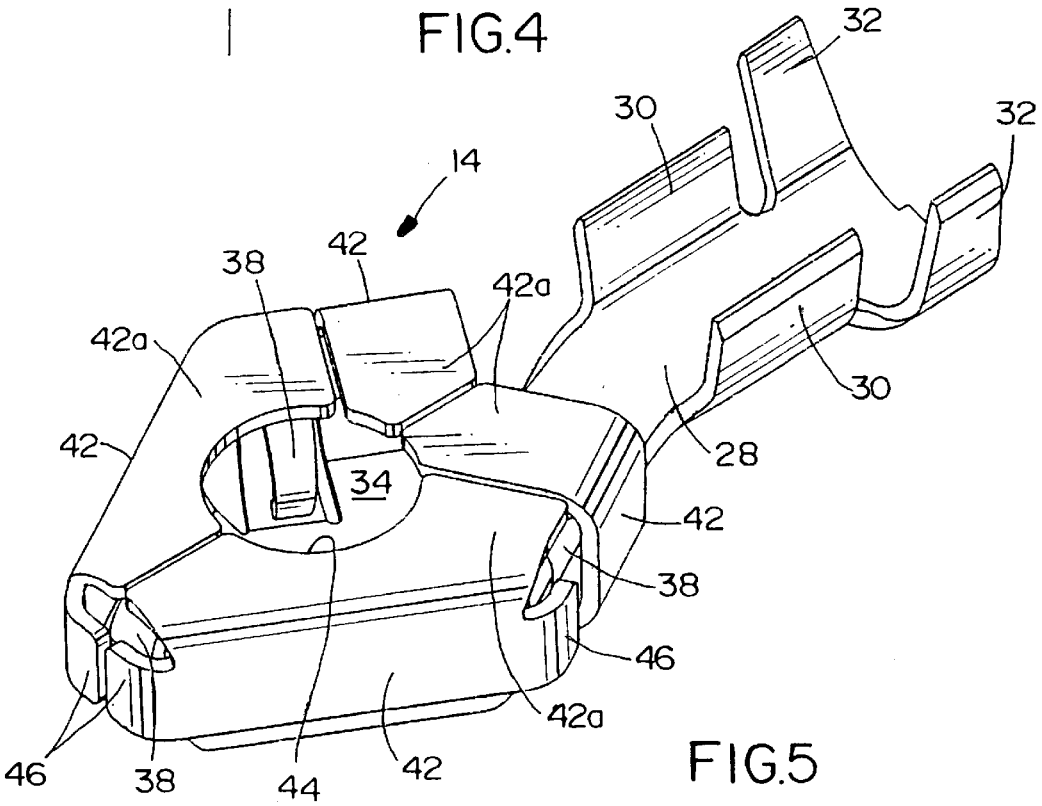
FIG. 5 is a bottom perspective view of the harness terminal.
Figure 7:
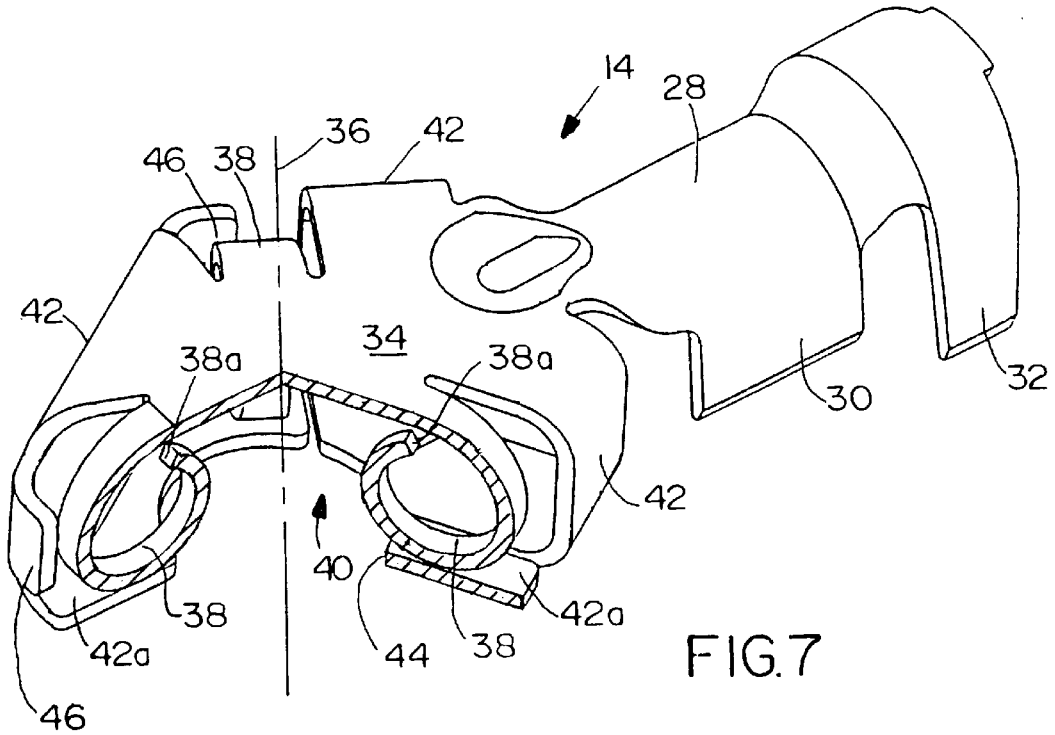
FIG. 7 is a top perspective view, partially cutaway, of the harness terminal.

Referring to FIGS. 4, 5 and 7 in conjunction with FIG. 1, harness terminal 14 is a one-piece terminal stamped and formed of conductive sheet metal material. The harness terminal is adapted for mating with glass terminal 12, and the harness terminal includes a crimp arm portion 28 for termination to an electrical lead from a power source, such as the power source of a vehicle. The lead typically is an insulated electrical wire or cable. Arm 28 has a first pair of crimping portions 30 for clamping on to the conductive core of the lead wire, and a second pair of crimping portions 32 for clamping onto the outer insulation of the lead wire to provide a strain relief means.

More particularly, harness terminal 14 includes a base portion 34 which is generally planar and perpendicular to a mating axis 36 which, when the harness terminal is mated with glass terminal 12, is coincident with central axis 22 (FIG. 6) of the glass terminal. A plurality of inwardly curved contact beams 38 are integral with and extend from base portion 34 and define an interior socket, generally designated 40 (FIG. 7), for receiving terminal post portion 20 of glass terminal 12. Contact beams 38 are spaced equidistant, circumferentially about axis 36. As best seen in FIG. 7, inwardly curved contact beams 38 are curved in a substantial circular loop and terminate in distal ends 38*a* juxtaposed beneath and slightly spaced from the underside of planar base portion 34.

Generally, harness terminal 14 includes a shell integral with and extending from base portion 34 exteriorly of contact beams 38 to provide protection for the beams. Specifically, the shell is provided by a plurality of shell fingers 42 spaced circumferentially about axis 36 of the harness terminal and between inwardly curved contact beams 38. Shell fingers 42 are formed or inwardly turned from base portion 34 around the bottom of the terminal and terminate in inwardly turned distal ends 42*a* which substantially close the bottom of the harness terminal except for a circular entrance 44 (FIG. 5) to interior socket 40 (FIG. 7). In particular, inwardly turned distal ends 42*a* of the shell fingers have arcuate edges as best seen in FIG. 5 which combine to define the circular configuration for entrance 44 to the interior socket of the terminal.

At least some of shell fingers 42, namely the two shell arms diametrically opposite crimp arm 28, are provided with laterally projecting portions 46 which are disposed outside contact beams 38 to protect the beams. This is particularly important during shipping, handling and assembly of the harness terminal which can be subjected to considerable abuse at various times prior to assembly to glass terminal 12.

As best seen in FIGS. 5 and 7, the inwardly turned distal ends 42*a* of the two shell fingers 42 diametrically opposite crimp arm 28 are disposed immediately beneath inwardly curved contact beams 38. Therefore, the distal ends of the shell fingers not only provide protection for the contact beams at the underside of the harness terminal, but the distal ends of the shell fingers also provide an anti-overstress means for the beams. In fabrication, contact beams 38 first are formed inwardly from base plate 34, and then shell fingers 42 are formed over the contact beams.

FIG. 3 best shows how dielectric cover 16 is mounted over harness terminal 14. Specifically, the cover includes a pair of inwardly directed flanges 50 which snap-fit over the pair of crimp portions 32 of crimp arm 28 of the harness terminal. Crimping portions 30 and 32 are shown in FIG. 3 in their crimped condition, but the lead wire is not shown in this depiction. Cover 16 is a one-piece structure unitarily molded of dielectric material such as plastic or the like. The cover has a very low profile matching the low profile of harness terminal 14.

Figure 8:
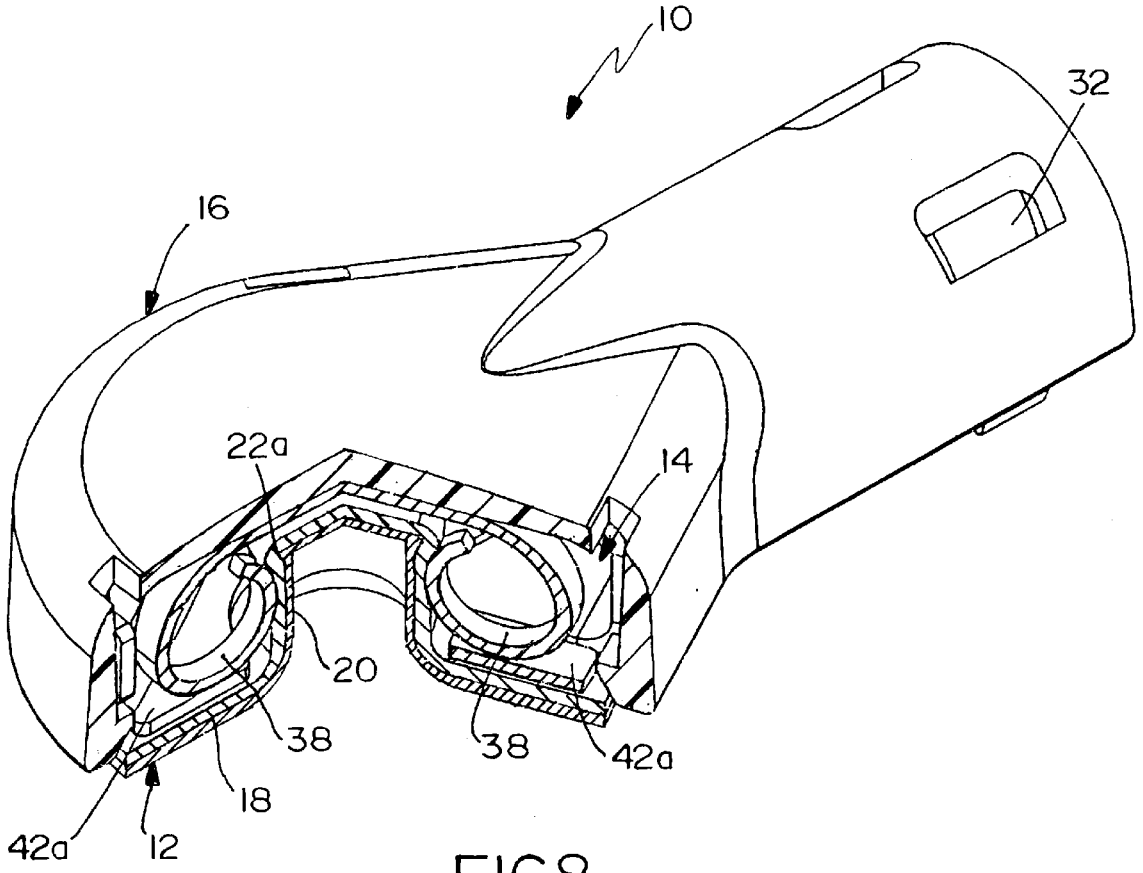
FIG. 8 is a top perspective view, partially cutaway, of the terminal assembly.

FIGS. 6 and 8 show terminal assembly 10 in mated or connected condition. In other words, harness terminal 14 is mated with glass terminal 12. The harness terminal is mated with the glass terminal in the direction of arrow "A" (FIG. 6). During mating, inwardly curved contact beams 38 flex radially outwardly when they engage the top of enlarged head 20*a* of terminal post 20 of the glass terminal. The contact beams then snap back inwardly behind the enlarged head of the terminal post in the mated condition of the terminal assembly as shown in FIGS. 6 and 8.

Figure 9:
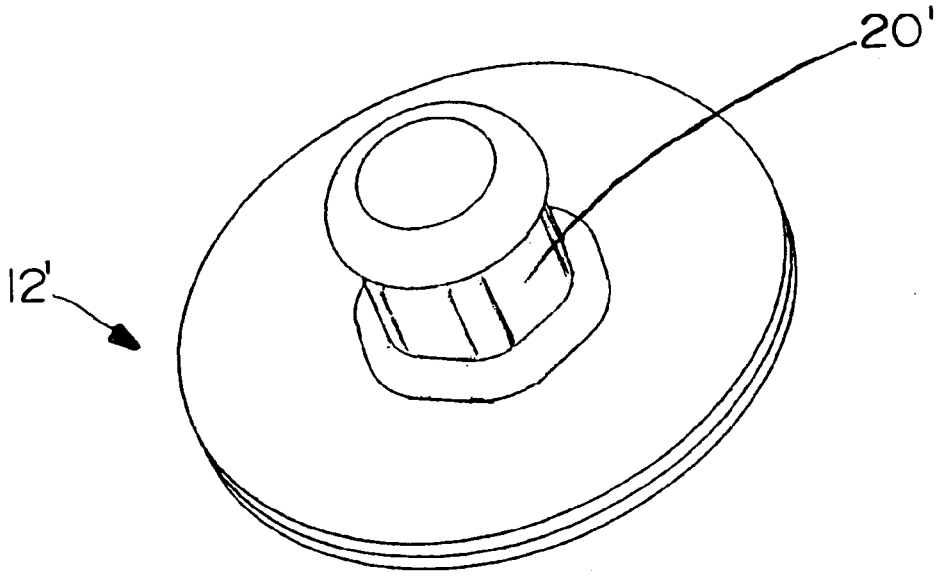
FIG. 9 is a top perspective view of a second embodiment of the glass terminal.

FIG. 9 shows a second embodiment of a glass terminal designated 12' also adapted for applying to a glass sheet but which upstanding terminal post portion 20' is hexagonally-shaped. This shape may be desirable in some applications where resistance to fretting corrosion and mechanical vibration is important. Upon mating, the points or sides of the hexagon lock in position with the contact beams and therefore avoid intermittent contact with the harness terminal.

The terminal assembly, particularly harness terminal 14, of the invention has an extremely low profile as can be seen in the drawings. The circularly curved contact beams 38 reduce the beam profile and increase the total contact deflection the beams will tolerate without taking excessive permanent set. This is particularly desirable since it provides a high contact force system that is tolerant of significant contact interface dimensional variations. Since the contact beams can potentially be damaged during fabrication, shipping, handling and assembly, the outside shell provided by shell fingers 42 not only provides significant protection for the contact beams but also provides an anti-overstress means. All extraneous or additional components are eliminated by this one-piece stamped and formed structure. Glass terminal 12 further provides an extremely efficient and effective connector assembly by allowing the glass terminal to be secured to a conductive pad on the glass sheet by a spin soldering (friction) process.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical terminal adapted for mounting to a glass sheet, comprising:

a unitary laminated structure consisting of a base conductor layer and a solder layer, the structure including a circular base plate defining a central axis generally perpendicular thereto, the base plate being generally concentric about said axis and being adapted to be fixedly mounted to a conductive pad on the glass sheet such that, upon mounting the terminal, the solder layer is in contact with the conductive pad; and a terminal post upstanding from the base plate along the central axis for connection to a corresponding mating terminal, the terminal post configured such that, upon mounting the terminal, the base conductor layer is in contact with the mating terminal.

2. The electrical terminal of claim 1, wherein said terminal post is generally cylindrical.

3. The electrical terminal of claim 1, wherein said terminal post is generally hexagonal.

4. The electrical terminal of claim 1 wherein said terminal post is of generally uniform cross-section and has an enlarged head portion.

* * * * *